United States Patent [19]

Pavek et al.

[11] 4,214,352

[45] Jul. 29, 1980

[54] NOZZLE FOR TEXTURING THREAD

[76] Miloslav Pávek; Miroslav Nováček; Jiří Fantl, all of Liberec; Jan Kára; Prague; Zdenek Kašpárek; Liberec, all of Czechoslovakia

[21] Appl. No.: 962,046

[22] Filed: Nov. 20, 1978

[30] Foreign Application Priority Data

Nov. 22, 1977 [CS] Czechoslovakia ..... 7680/77

[51] Int. Cl.[2] ..... D02G 1/16

[52] U.S. Cl. ..... 28/254

[58] Field of Search ..... 28/254, 257, 271

[56] References Cited

U.S. PATENT DOCUMENTS

| | | | |
|---|---|---|---|
| 2,938,256 | 5/1960 | Bauer et al. | 28/271 |
| 3,831,363 | 8/1974 | Pike | 28/271 X |
| 4,097,975 | 7/1978 | Moeller | 28/254 |
| 4,107,828 | 8/1978 | Clendening, Jr. et al. | 28/254 |

FOREIGN PATENT DOCUMENTS

| | | | |
|---|---|---|---|
| 47-38906 | 10/1972 | Japan | 28/257 |

*Primary Examiner*—Robert Mackey

[57] ABSTRACT

There is disclosed a nozzle for texturing thread by a gaseous fluid stream. The nozzle is provided with a first duct for guiding the thread and a second duct for feeding the gaseous fluid and opening at an angle or skewed into the first duct. The section of the first duct is angular; to the exit end of the first duct there is attached a texturing bridge formed by a tube provided with a longitudinal recess which is directed opposite to the exit end of the first duct.

1 Claim, 3 Drawing Figures

NOZZLE FOR TEXTURING THREAD

The present invention relates to a nozzle for texturing thread by a gaseous fluid stream, said nozzle being provided with a first duct for guiding the thread and a second duct for guiding the gaseous fluid, the second duct opening into the first duct.

At present, a plurality of different nozzles intended for texturing thread are known. Thus, e.g. a nozzle is used which is provided with three ducts for for supplying gaseous fluid, such three ducts opening into the duct for guiding the thread. The exit ends of the three ducts for feeding the gaseous fluid into the duct for guiding the thread are chosen in such manner as to enable the flowing gaseous fluid to untwist the thread and to throw it against a texturing bridge which forms part of the nozzle and which is arranged either inside the duct for guiding the thread or opposite thereto, and on which the actual texturing of the thread is performed.

The known nozzle as described above, intended for texturing thread, has serious disadvantages, although good results are obtained therewith in texturing. The main disadvantage of such nozzle is that only threads can be textured therein which have already been preliminarily provided with a twist. However, the nozzle can be utilized only in a single purpose manner for a certain range (denier) of count of the thread and for one twist type, e.g. S. For another twist type, or another count, it is necessary to utilize a nozzle for texturing thread which has been appropriately modified as to its dimensions, and with ducts for feeding gaseous fluid adapted thereto. A further disadvantage thereof consists in the short life time due to the abrasion of the nozzle by the thread, and in its very difficult manufacturing reproducibility, as it is only possible to manufacture two nozzles having exactly the same properties with great difficulties. The last mentioned disadvantage is partially mitigated by an adjustable nozzle for texturing thread in which the position of the duct for feeding gaseous fluid is adjustable relative to the duct for guiding the thread. The adjustment of a plurality of those nozzles in the machine is, however, rather time-consuming and entails the danger that the uniformity of operation of the texturing technology in the machine might be seriously disturbed by the intervention of the attendants.

The above-mentioned disadvantages are mitigated in the nozzle of the present invention for texturing thread by a gaseous fluid stream. Such nozzle is provided with a first duct for guiding a thread and a second duct for feeding a gaseous fluid, the second duct opening into the first duct. The section of the first duct for guiding a thread, is angular and to the mouth or exit end of the first duct, there is attached a texturing bridge formed by a tube with a longitudinal recess which is directed opposite to the exit end of the first duct.

It is advantageous, from the viewpoint of the texturing results achieved, when the longitudinal axis of the tube is skewed or disposed at an angle with respect to the longitudinal axis of the first duct, the longitudinal recess being directed toward and intersecting the longitudinal axis of the channel or first duct for guiding the thread. It is also advantageous that the recess has a wedge shape.

The nozzle according to the present invention is also advantageous since it is very simple in its construction and thus is easy to manufacture.

Further advantages and features of the present invention will be evident upon consideration of the embodiment in the form of an example which is shown in diagrammatic form in the accompanying drawing, in which.

Figure 1:
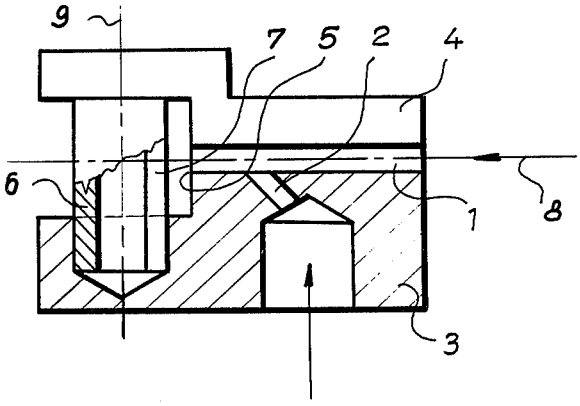
FIG. 1 is a front view of the nozzle in partial section.
Figure 2:
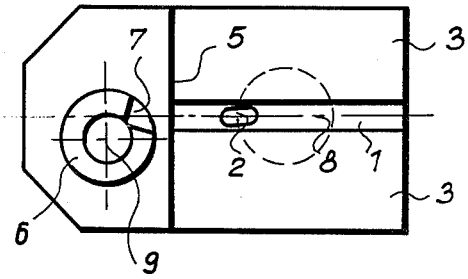
FIG. 2 is a plan view of the nozzle as shown in FIG. 1 with the lid thereof removed.
Figure 3:
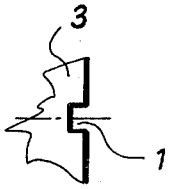
FIG. 3 is a detailed view in end elevation of the first duct, for guiding the thread.

The nozzle of the invention for texturing thread by a gaseous fluid stream is provided with a first duct 1, for guiding a thread, and a second duct 2, for feeding gaseous fluid thereinto, the latter opening at an acute angle into duct 1.

The duct 1 for guiding the thread has an angular section, e.g. of rectangular shape, for the purpose of preventing the thread from rotary motion about the axis of the thread. Said duct 1 is formed e.g. by a groove in a nozzle body 3, which is closed from above by a lid 4 which is disengageably connected with the said nozzle body 3. Thus, it is easily possible to provide the correct disposition of the mouth of duct 2, for feeding gaseous fluid into the duct 1 for guiding the thread. This is important for maintaining the desired properties of the nozzle in the mass production thereof.

In the drawings, the said duct 2 for feeding gaseous fluid is shown disposed in the nozzle body 3.

To the exit end 5 of duct 1, there is attached a texturing bridge formed by a tube 6, the ends of which are fixed in the lid 4 and nozzle body 3, respectively. The tube 6 is arranged in such manner that its longitudinal axis is skewed or disposed at an angle relative to the longitudinal axis 8 of the duct 1. In the direction of the longitudinal axis 9 of the tube 6, a recess 7, advantageously wedge-shaped, is provided, the recess being disposed opposite to the exit end 5 of the duct 1.

The nozzle according to the present invention operates as follows:

The thread enters duct 1 in the direction from right to left in FIG. 1, in which it is acted upon by the gaseous fluid stream fed through duct 2. The thread is opened by the streaming gaseous fluid to separate fibers and is thrown in this condition into recess 7 of the texturing bridge, in which loop formation and entanglement of the separate fibers take place. Thus, the thread is shortened and its volume simultaneously increased. The degree of shortening is given by the ratio between the speed of feeding the thread into the speed of withdrawing the thread from the nozzle. The thread textured in such manner is withdrawn through recess 7 into the interior of tube 6 and then out of the tube.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. Nozzle for texturing thread by a gaseous fluid stream, comprising a first duct for guiding the thread and a second duct for feeding the gaseous fluid, the second duct opening into the first duct and being disposed at a substantial angle with respect thereto, the first duct having an angular cross section, a texturing bridge disposed at the exit of the first duct formed by a hollow tube having an axis skewed relative to the longitudinal axis of the first duct, the tube having an open end and a side wall which is provided with a longitudinal wedge-shaped opening, disposed opposite the exit opening of the first duct, the longitudinal opening extending through the sidewall of the tube to the hollow interior thereof being directed angularly toward and intersecting the longitudinal axis of the first duct, the thread being pre-textured as it enters the first duct through which it travels in a longitudinal direction in a first plane past the intersection of the first and second ducts, thence entering through the opening in the side wall of the tube wherein it is subjected to final texturing and thence being withdrawn through the same opening in a second plane different from the first entry plane thereof for withdrawal from the interior of the hollow tube through the open end.

* * * * *